US005709258A

United States Patent [19]

Coccoluto

[11] Patent Number: 5,709,258

[45] Date of Patent: Jan. 20, 1998

[54] SAFETY ARRANGEMENT FOR WINDOW BLINDS

[75] Inventor: Robert T. Coccoluto, Orono, Minn.

[73] Assignee: Advanced Design Group, LLC, Orono, Minn.

[21] Appl. No.: 643,031

[22] Filed: May 2, 1996

[51] Int. Cl.[6] ..... E06B 9/30

[52] U.S. Cl. ..... 160/168.1 R; 160/178.1 R; 160/178.2 R; 160/320; 16/122

[58] Field of Search ..... 160/168.1 R, 178.1 R, 160/178.2 R, 320; 16/122, 125

[56] References Cited

U.S. PATENT DOCUMENTS

| | | | |
|---|---|---|---|
| 2,357,911 | 9/1944 | Schaefer | 160/178.2 R X |
| 2,494,759 | 1/1950 | Hirschy | 160/178.2 R X |
| 3,276,511 | 10/1966 | Armenia et al. . | |
| 3,485,285 | 12/1969 | Anderle . | |
| 4,180,118 | 12/1979 | Vecchiarelli | 160/178.2 R |
| 4,327,797 | 5/1982 | Nakajima et al. | 160/178.2 R X |
| 4,425,956 | 1/1984 | Terlecke | 168/168 R |
| 4,433,713 | 2/1984 | Kelly | 160/166 |
| 4,673,018 | 6/1987 | Judkins . | |
| 4,687,041 | 8/1987 | Anderson . | |
| 4,719,955 | 1/1988 | Tachikawa et al. . | |
| 4,719,956 | 1/1988 | Valle | 160/178.2 R |
| 4,817,698 | 4/1989 | Rossini et al. . | |
| 4,865,108 | 9/1989 | Hennequin et al. . | |
| 5,143,135 | 9/1992 | Kuhar | 160/107 |
| 5,316,066 | 5/1994 | Rapp et al. | 160/178.2 R |
| 5,465,775 | 11/1995 | Biba et al. . | |
| 5,472,035 | 12/1995 | Biba et al. | 160/178.1 R X |
| 5,513,687 | 5/1996 | Tuzmen et al. . | |
| 5,553,649 | 9/1996 | Chisaka et al. | 160/178.2 R X |
| 5,595,232 | 1/1997 | Benthin | 160/178.1 R |

FOREIGN PATENT DOCUMENTS

| | | | |
|---|---|---|---|
| 258549 | 11/1967 | Austria . | |
| 1966483 | 3/1973 | Germany | 160/178.2 R |
| 683115 A5 | 11/1991 | Switzerland . | |

*Primary Examiner*—Anthony Knight
*Assistant Examiner*—Bruce A. Lev
*Attorney, Agent, or Firm*—Merchant, Gould, Smith, Edell Welter & Schmidt

[57] ABSTRACT

An arrangement for raising and lowering window blinds includes a holder and a handle. A holder is constructed and arranged for holding the second region of the liftcords at a height substantially equal to a height of the headrail and forming a closed loop in the liftcords. A handle is adapted for engaging the closed loop of the liftcords. The blinds are raised or lowered responsive to a pulling force exerted on the handle. A headrail includes a locking ball and a holder adjacent to the locking ball. The holder is constructed and arranged to releasably hold the free region of the liftcords. A kit for retrofitting window blinds includes a handle and a clip.

16 Claims, 5 Drawing Sheets

SAFETY ARRANGEMENT FOR WINDOW BLINDS

FIELD OF THE INVENTION

The present invention relates to window blinds. More particularly, the invention relates to a safety arrangement for raising and lowering window blinds.

BACKGROUND OF THE INVENTION

Window blinds commonly are designed to have liftcords which hang down from the top of the blind. To raise the blinds, the liftcords are manually pulled with a direct 1:1 ratio between the length which the liftcords must be pulled down and the length by which the window blind is raised. Because of this 1:1 ratio and because of the usual stringing arrangement, when the blinds are in the raised position, the liftcords hang well below the bottom of the blind. This presents a safety hazard for children, who can accidentally strangle themselves with the liftcords. Further, dangling liftcords can present other problems if, for example, the liftcords dangle over a stove or a radiator.

Window blinds, particularly Venetian blinds, are prevalent in homes, schools, offices, etc. Because of their universal usage, it would be most convenient if existing blinds could be easily modified, or retrofitted, in order to address the safety problem of dangling cords.

Various patents have been directed to different liftcords arrangements for window blinds. For example, see U.S. Pat. Nos. 3,276,511; 3,485,285; 4,673,018; 4,687,041; 4,719,955; 4,817,698; 4,865,108; and 5,465,775; Austrian Pat. No. 258549; and Swiss Pat. No. 683115. However, none of these patents change the direct 1:1 ratio between the length which the liftcords must be pulled and the length which the blind must be raised. Further, most of these arrangements are complex, and would not allow for convenient retrofitting of existing installed window blinds.

Consequently, a need exists for an arrangement for raising and lowering window blinds which overcomes the aforementioned shortcomings associated with existing arrangements.

SUMMARY Of THE INVENTION

The present invention is directed to an arrangement for raising and lowering window blinds that substantially obviates one or more of the problems due to limitations and disadvantages of the prior art.

To achieve the advantages of the invention and in accordance with the purposes of the invention, as embodied and broadly described herein, the invention comprises an arrangement for raising and lowering window blinds. The window blinds have a headrail and liftcords with a first region attached to the blinds and a second free region. The arrangement includes a holder and a handle. A holder is constructed and arranged for holding the second free region of the liftcords at a height substantially equal to a height of the headrail and forming a closed loop in the liftcords. A handle is for engaging the closed loop of the liftcords. The blinds are raised or lowered responsive to a pulling force exerted on the handle.

Preferably, the holder includes clip structure for frictionally holding the liftcords. More preferably, the clip structure is a clip having first and second opposed surfaces for retaining the liftcords between the headrail and the clip.

The holder may include a bracket for mounting the clip structure to a wall. The bracket may be U-shaped, and the clip structure may be a clip having first and second opposed surfaces for retaining the liftcords between the bracket and the clip.

The window blinds may include a locking mechanism for locking a vertical height of the blinds. In that implementation, the holder may include a spring-biased pawl operatively associated with the locking mechanism.

Preferably, the handle includes a freely rotating pulley engaging the closed loop of the liftcords. The handle may define a through hole for allowing the liftcords to be threaded through and engage the pulley.

In another implementation, the handle may include an elongated tube having a longitudinal axis and first and second opposite ends; a shuttle accommodated within the tube and including a pulley; and wherein the tube and shuttle define a pair of channels for allowing the liftcords to be passed through and engage the pulley. The handle may further include a locking mechanism connected to the shuttle for releasably locking the shuttle near either the first end or the second end. The tube may define an elongated slot; and the shuttle may include a pin for sliding within the slot. The first end of the tube may define a first aperture, and the second end of the tube may define a second aperture. The locking mechanism may include a spring-biased locking pin mounted in the shuttle for engaging the first and second apertures.

In another aspect, the invention comprises a kit for retrofitting window blinds. The kit includes a clip and a handle. The clip has first and second opposed surfaces for frictionally grasping the liftcords and holding the liftcords at a height substantially equal to the headrail. The handle has a transverse pin for low-friction engagement of the liftcords.

The kit may also include a wall bracket for mounting to a wall, wherein the clip snaps onto the wall bracket.

In another aspect, the invention comprises a headrail for window blinds. The headrail includes a locking ball and a holder. The locking ball has a first plurality of teeth and is moveable between first and second positions. The first position includes the first teeth engaging the liftcords to lock the blinds in a desired vertical location. The second position includes the first teeth free from the liftcords to allow the liftcords to move responsive to a pulling force. A holder is adjacent to the locking ball and is constructed and arranged to releasably hold the free region of the liftcords.

Preferably, the holder includes a pawl having a second plurality of teeth, the second teeth for engaging the free region of the liftcords.

The headrail may further include a wall having serrations between the locking ball and the pawl, the serrations for engaging the first teeth. In certain implementations, the headrail may further include a spring engaging the pawl for biasing the pawl toward the wall, and wherein the free region of the liftcords are held between the serrations and the second teeth.

Preferably, the wall is slanted toward the pawl to trap the free region of the liftcords between the wall and the pawl.

It is to be understood that both the foregoing general description and the following detailed description are exemplary and explanatory only and are not restrictive of the invention, as claimed.

The accompanying drawings, which are incorporated in and constitute a part of this specification, illustrate one embodiment of the invention and together with the description, serve to explain the principles of the invention. In the drawings:

DESCRIPTION OF THE ILLUSTRATED EMBODIMENTS

Figure 1:
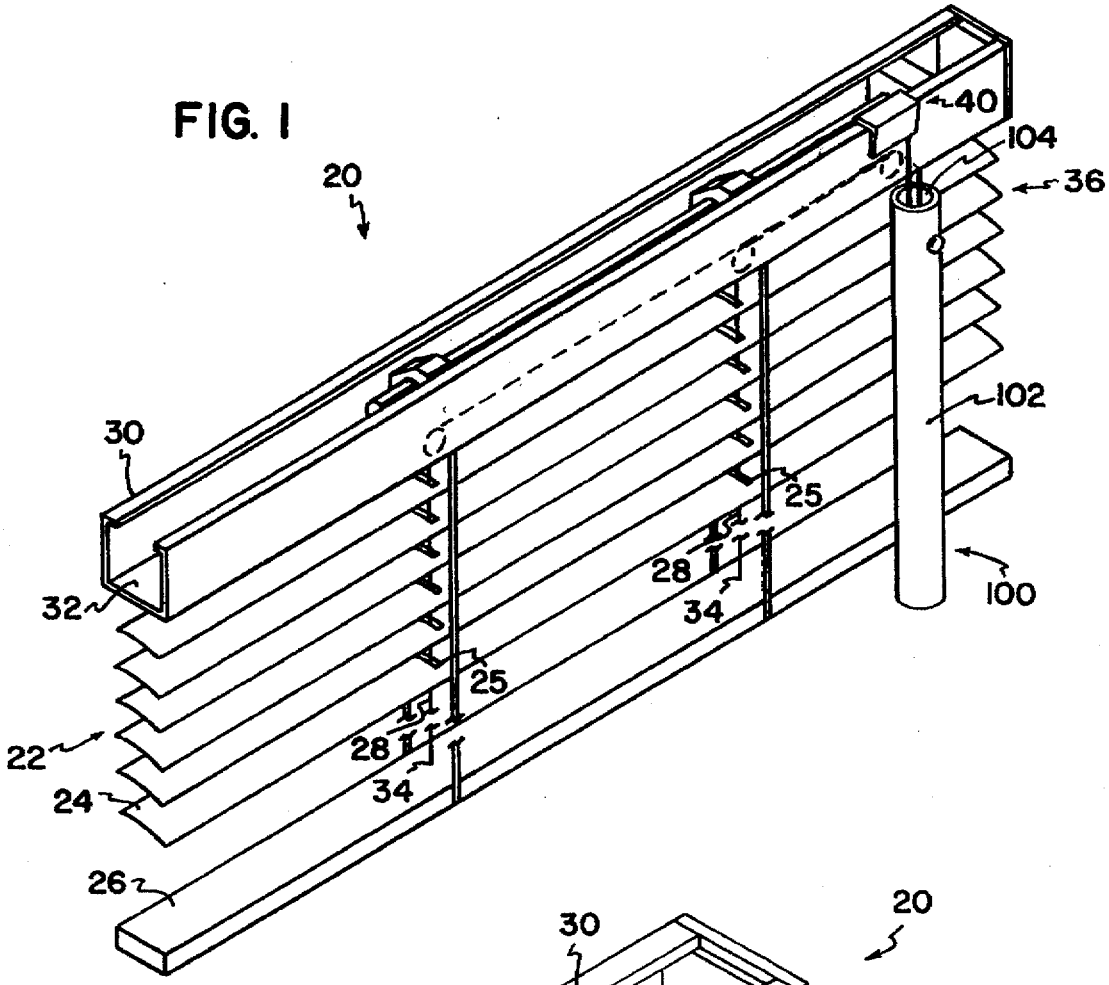
FIG. 1 is a perspective view of a safety arrangement embodying the present invention.

Reference will now be made in detail to the present preferred embodiments of the invention, an example of which is illustrated in the accompanying drawings. Whenever possible, the same reference numbers will be used throughout the drawings to refer to the same or like parts.

In accordance with the invention, the invention comprises an arrangement for raising and lowering window blinds having liftcords and a headrail. The arrangement advantageously results in liftcords which do not dangle dangerously within the reach of children or over stoves or radiators. The arrangement achieves this advantage by changing the ratio between displacement of the liftcords and displacement of the blinds from 1:1 to something less than that by creating leverage.

As embodied herein, an arrangement according to the invention is shown in FIGS. 1, 2 and 4–7 generally at 20. Arrangement 20 is adapted for raising and lowering window blinds 22. Blinds 22 may include a series of slats 24 and a bottom rail 26. Each of slats 24 defines a pair of slots 25. A pair of liftcords 28 extend through slots 25, one liftcord in each slot 25 of each slat 24, and attach to bottom rail 26 at attached region 34. Blinds 22 include a headrail 30. Headrail 30 is generally an elongated U-shaped structure with a base 32° Base 32 holds liftcords 28 and allows liftcords 28 to extend from attached region 34 to a free region 36, where liftcords dangle outside of headrail 30. Without arrangement 20, liftcords 28 would dangle freely and unattached to any structure along one side of blinds 22. Without the arrangement of the invention, to raise and lower the blinds, a user would exert a pulling force on the free region of the liftcords which would pull the bottom rail up to the same vertical displacement as the vertical displacement of the liftcords.

In accordance with the invention, the arrangement includes a holder constructed and arranged for holding the free region of the liftcords at a height substantially equal to a height of the headrail. As embodied herein, a holder is shown generally at 40, and may include any of several embodiments.

Figure 5:
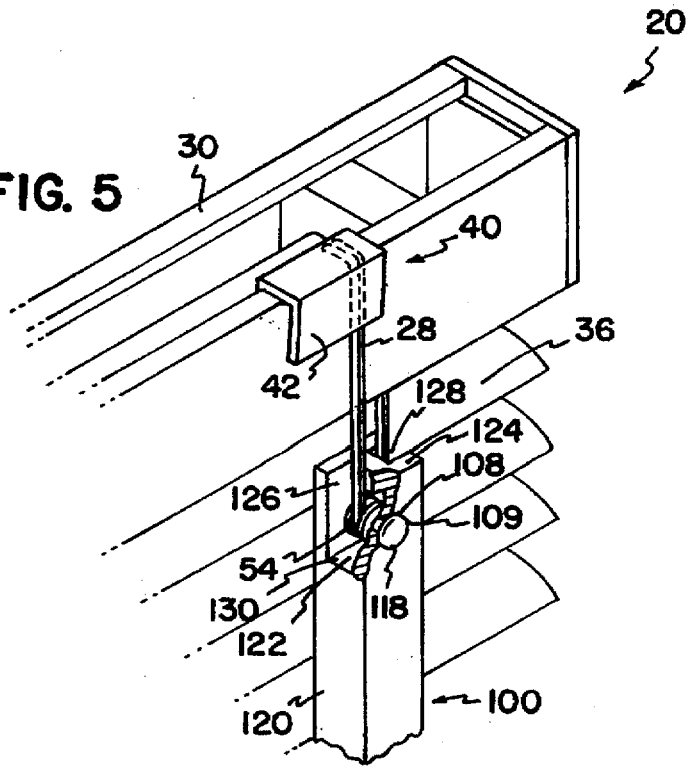
FIG. 5 is a perspective view of the FIG. 4 embodiment, partially broken away, embodying the present invention.
Figure 6:
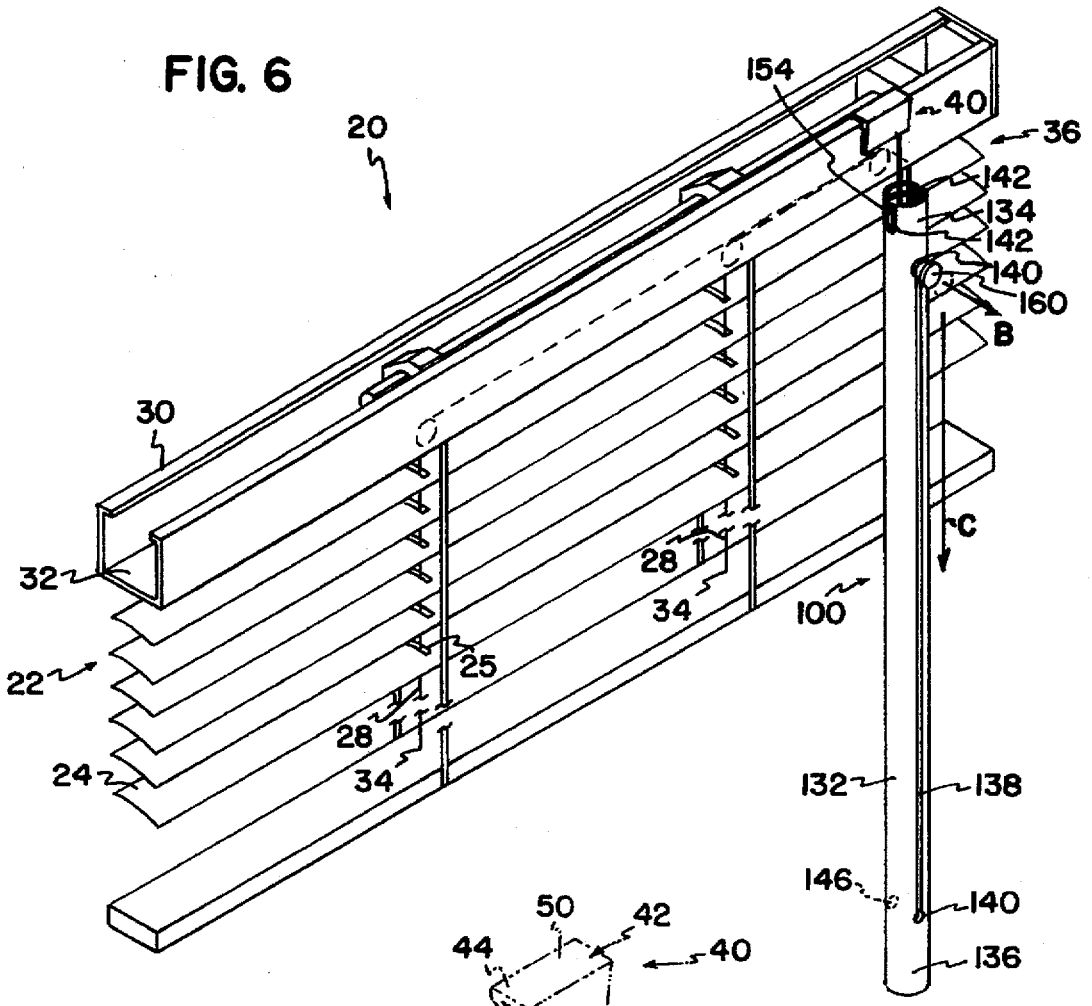
FIG. 6 is a perspective view of a third embodiment of a safety arrangement embodying the present invention.
Figure 7:
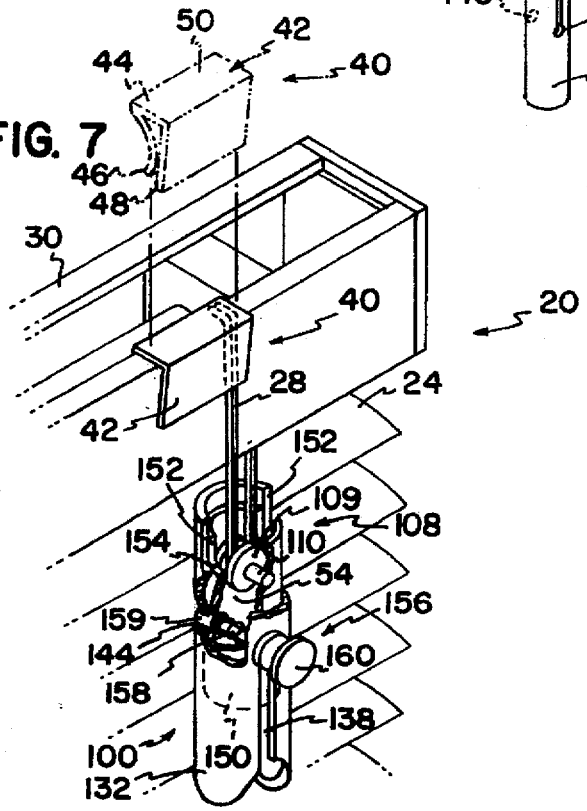
FIG. 7 is a perspective view of the FIG. 6 embodiment, partially broken away, embodying the present invention.
Figure 8:
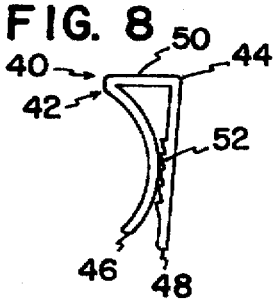
FIG. 8 is an elevational view of an embodiment of a clip embodying the present invention.

In a first illustrated embodiment, holder 40 includes a clip structure 42 (FIGS. 1, 2, and 4–8). Clip structure 42 may be a variety of shapes, so long as it accomplishes the function of holding the liftcords by the use of pressure and friction. One particular clip structure 42 is shown in FIGS. 7 and 8 as a clip 44. Clip 44 includes first and second opposed surfaces 46, 48 joined at a bight section 50. First surface 46 is a generally concave surface, curved toward second surface 48. Second surface 48 includes serrations 52. Clip 44 is made of a resilient material which allows for first and second surfaces 46, 48 to be spread apart from each other in order to engage a mating surface, but which resiliently spring back in order to frictionally engage the mating surface. The material may be a rigid plastic or metal. As illustrated in FIG. 7, clip 44 engages headrail 30. That is, first and second surfaces 46, 48 spread apart from each other from the position of FIG. 8 to ride over opposing surfaces of headrail 30. First and second surfaces 46, 48 press toward each other to tightly hold onto headrail 30. Free region 36 of liftcords 28 may be held between first and second surfaces 46, 48 and headrail 30 to hold free region 36 at a height substantially equal to the height of the headrail 30. Serrations 52 aid in frictionally locking liftcords 28 in place between second surface 48 and headrail 30. When free region 36 of liftcords 28 is held to headrail 30, a loop 54 (FIG. 2) in liftcords 28 is created. A function of loop 54 will be explained below in conjunction with a handle according to the invention.

Figure 9:
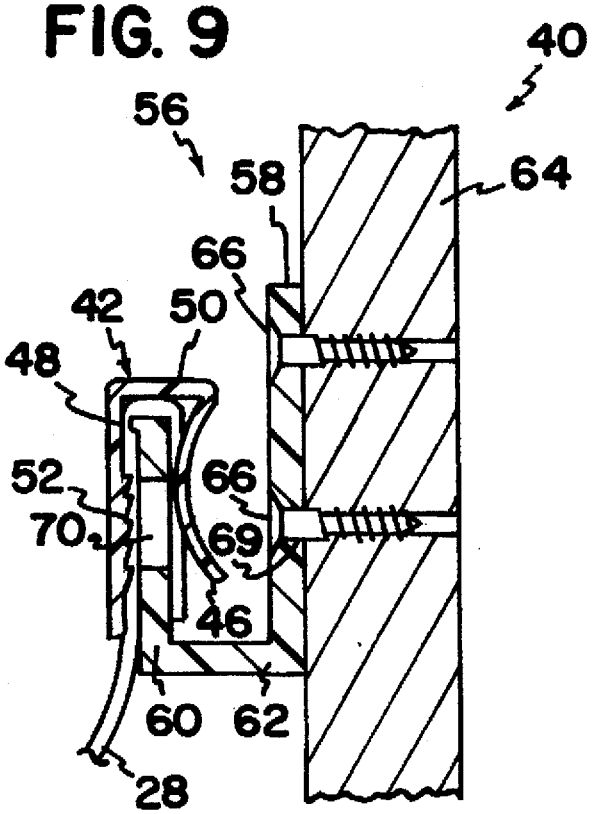
FIG. 9 is a cross-sectional view of an embodiment of a wall bracket embodying the present invention.
Figure 10:
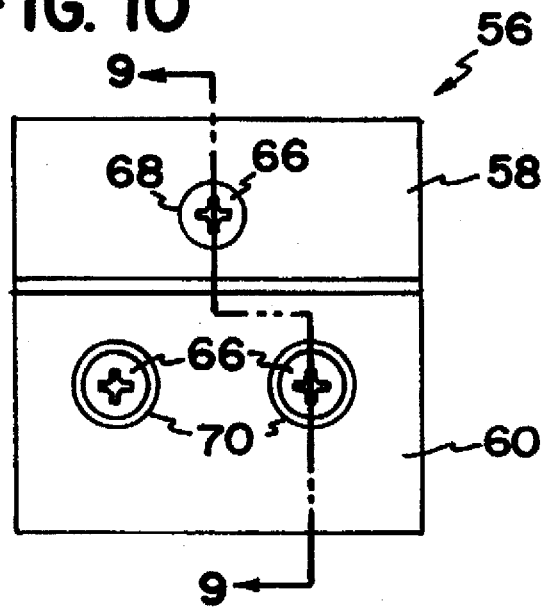
FIG. 10 is an elevational front view of the wall bracket of FIG. 9.

In another illustrated embodiment, holder 40 includes a bracket 56 depicted in FIGS. 9 and 10. Bracket 56 is generally U-shaped having first and second legs 58, 60 joined at a base 62. First leg 58 is longer than second leg 60 to allow for easier mounting to a wall 64. Wall 64 could include a wall immediately adjacent to blinds 22, or it could include any stable structure in the vicinity of blinds 22. Bracket 56 may be mounted to wall 64 in a variety of ways. In the illustrated embodiment, bracket 56 is mounted via three conventional screws 66. First leg 58 includes a top hole 68 and a pair of bottom holes 69 for accommodating screws 66. Second leg 60 defines a pair of holes 70 for allowing tool access to bottom holes 69 for mounting bracket 56 to wall 64. Second leg 60 may be used to accommodate clip structure 42 in order to hold liftcords 28 at a height substantially equal to a height of headrail 30. In FIG. 9, clip structure 42 is shown as clip 44 engaging second leg 60, and retaining liftcords between bracket 56 and clip 44. Bracket 42 may be used to hold liftcords 28 at a height not only the same as that of headrail 30, but also at heights greater than or less than that of headrail 30, depending on the particular application, so long as a loop is formed in the liftcords. If it is impossible, inconvenient, or unsightly to attach the liftcords directly to the headrail, the bracket may be used to create the loop.

Figure 12:
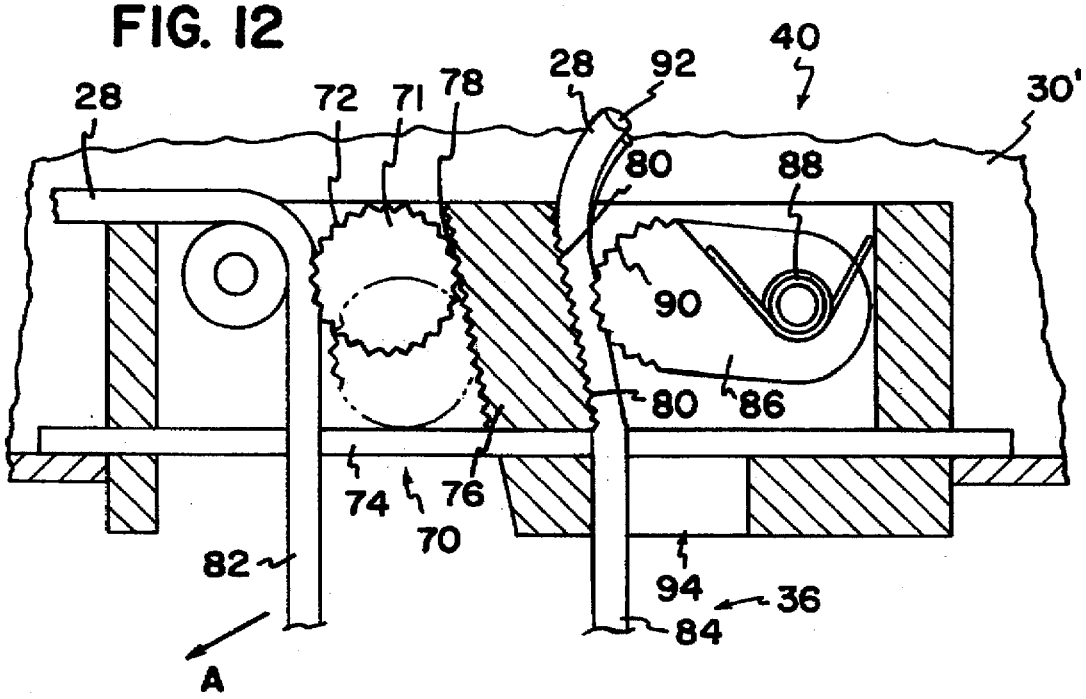
FIG. 12 is a cross-sectional view of the FIG. 11 embodiment.

A third illustrated embodiment of holder 40 is shown in FIG. 12 as constituting part of a modified headrail 30' Headrail 30' includes locking structure 70 for locking the position of liftcords 28 in order to lock the vertical position of blinds 22. The locking structure 70 includes a locking ball 71. Locking ball 71 is cylindrical in shape with a circular cross-section and includes teeth 72 all around its periphery. Locking ball is movable between a first position, shown in FIG. 12, when teeth 72 engage liftcords 28 and lock liftcords 28 in a desired position, and a second position, shown in phantom in FIG. 12. In the second position, locking ball teeth 72 do not engage liftcords 28, to allow liftcords 28 to move freely and to raise and lower blinds 22. A bar 74 extends laterally across headrail 30' and functions to connect the locking structure 70 to headrail 30+ and to keep each of the liftcords separated from the other. A serrated wall 76 is integral with headrail 30+ and slants toward holder 40 and includes first and second opposite serrations 78, 80. First serrations 78 engage teeth 72 of locking ball 71 and guide locking ball 71 between its first and second positions. Second serrations 80 function to engage holder 40, as will be explained below. When a user desires to adjust the vertical position of the blinds, the user pulls liftcords 28 in a direction of arrow A. This disengages locking ball 71 from liftcords 28 and permits locking ball 71 to drop to its second position shown in phantom in FIG. 12. Liftcords 28 are then pulled by the user until the blinds are at their desired location. At that point, the user lets go of liftcords 28 and locking ball 71 moves upwardly to the first position and engages the liftcords.

Figure 2:
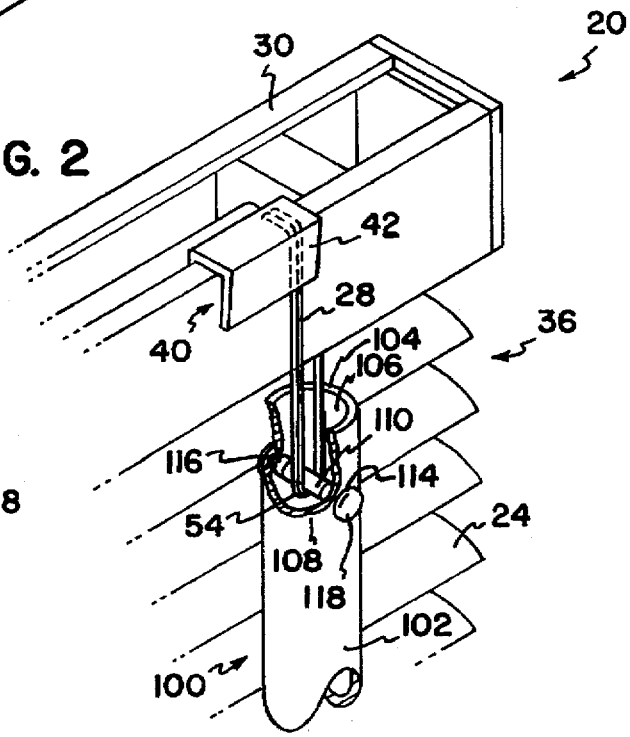
FIG. 2 is a perspective view of the FIG. 1 embodiment, partially broken away, embodying the present invention.
Figure 11:
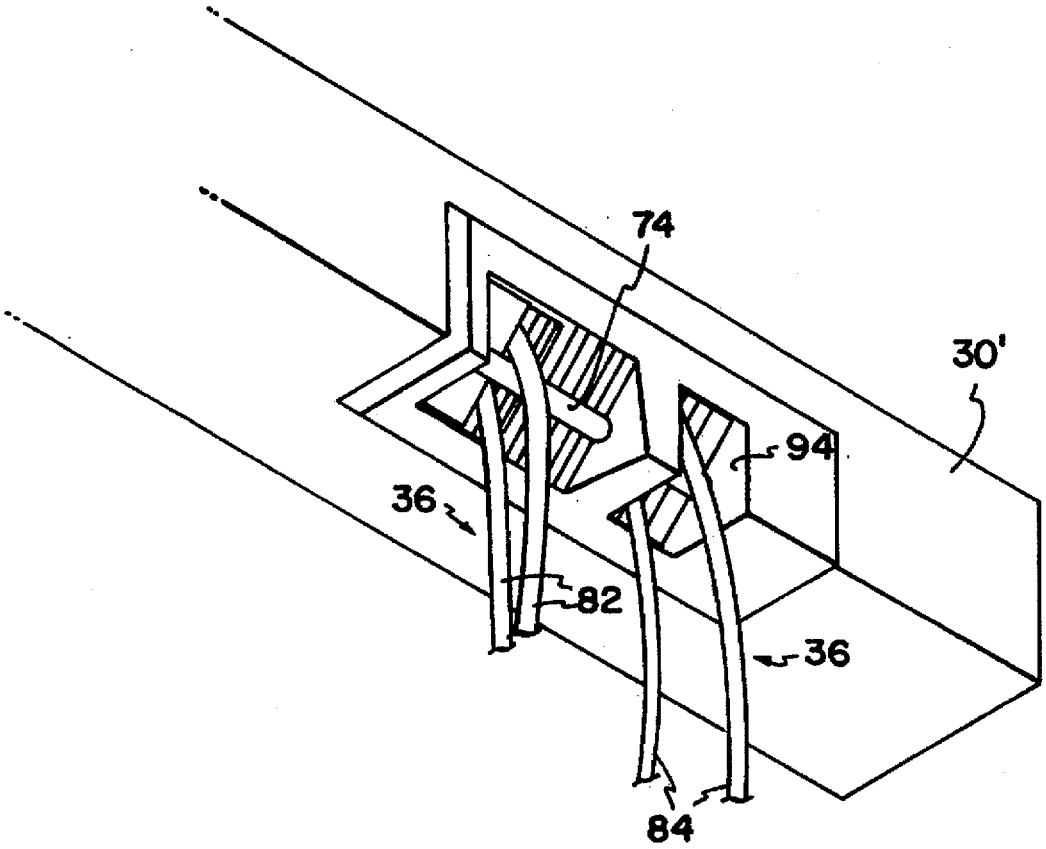
FIG. 11 is a perspective view of an embodiment of a headrail with a holder embodying the present invention.

FIG. 11 shows liftcords 28 emerging from headrail 30' and locking structure 70. Emerging liftcords are designated as 82. A loop 54, such as that shown in FIG. 2, is formed in the liftcords by returning them back to headrail 30'. The returning liftcords are designated as 84. It should be understood that returning liftcords 84 are part of free region 36 of liftcords 28. That is, returning liftcords 84 are any part of the liftcord which freely dangles alongside blinds 22.

Holder 40 is incorporated into headrail 30' by locking pawl 86 and spring 88. Locking pawl 86 is laterally adjacent to locking structure 70 and is constructed and arranged for releasably holding free region 36 of the liftcords. Specifically, pawl 86 includes teeth 90 for engaging free region 36 of the liftcords. Serrated wall 76 is located between locking ball 71 and pawl 86. Second serrations 80 on wall 76 cooperate with holder 40 to releasably hold liftcords 28 between wall 76 and teeth 90 on pawl 86. Ends 92 of liftcords 28 are shown emerging from above holder 40. Spring 88 acts on pawl 86 to bias pawl 86 toward wall 76. The slant of wall 76 functions to trap liftcords 28 between pawl 86 and wall 76.

Headrail 30' incorporating holder 40 advantageously results in allowing for an easy shortening of the desired length of the loop. If a user desires to shorten the loop, the user would merely pull on ends 92, and spring 88 would allow pawl 86 to be moved out of tight frictional engagement with liftcords and wall 76. If a user desires to lengthen the loop, any type of pointed device, such as a screwdriver or pen, may be inserted through opening 94 and push on pawl 86 against spring 88. Headrail 30' is designed so that lengthening the loop is not as convenient or easy as shortening the loop because inadvertent lengthening of the loop may be undesirable.

In accordance with the invention, the arrangement includes a handle for engaging the closed loop of the liftcords. As embodied herein, a handle is illustrated in FIGS. 1, 2, and 4–7 generally at 100. Handle 100 functions to engage and hold loop 54. To raise or lower blinds 22, a user grasps handle 100 and exerts a pulling force. Handle 100 may include any of several embodiments, provided that it accomplishes the function of engaging the closed loop and allows the user to raise and lower the blinds.

Figure 3:
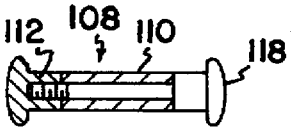
FIG. 3 is a cross-sectional view of an embodiment of a pulley shown in FIG. 2, embodying the present invention.

In a first embodiment illustrated in FIGS. 1 and 2, handle 100 is shown as a cylinder 102. Cylinder 102 is generally cylindrical in shape and includes at least one open end 104 leading to an interior space 106. Cylinder 102 includes a freely rotating pulley 108 for engaging loop 54. Pulley 108 includes an arbor 110 bridging radially through interior space 106 from first side 114 of cylinder 102 to second side 116 of cylinder 102. Arbor 110 includes a head 118, and is attached to cylinder 102 through a threaded fastener 112 (FIG. 3) in a way which permits arbor 110 to freely rotate when mounted in cylinder 102. Arbor 110 is a transverse pin and is made of a material such that, when engaged with the loop of the liftcords, has low-friction contact with the liftcords. Threaded fastener 112 separates from arbor 110 and allows arbor 110 to be removed from cylinder 102 through first side 114. Head 118 prevents arbor 110 from slipping all of the way through first side 114. Pulley 108 allows liftcords 28 to easily slide through handle 100.

Figure 4:
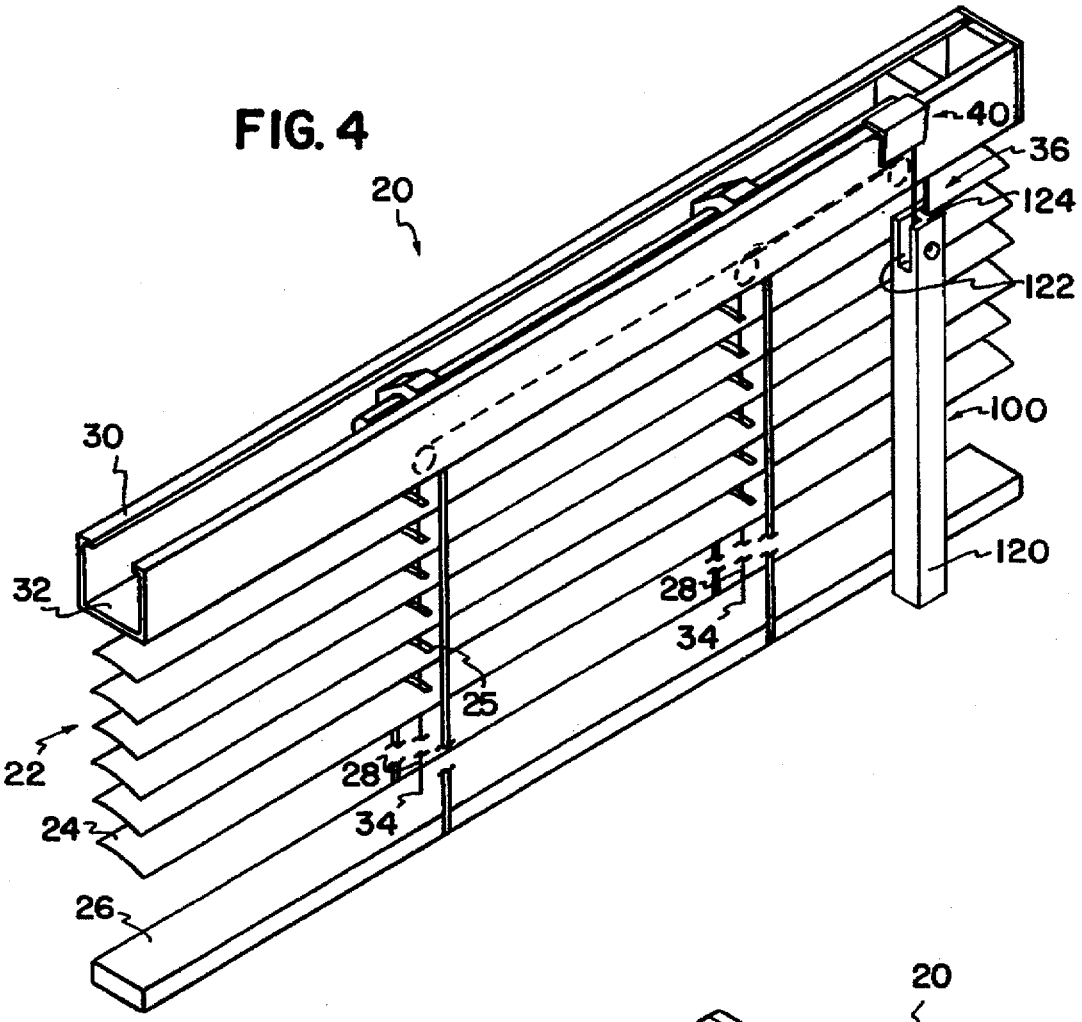
FIG. 4 is a perspective view of a second embodiment of a safety arrangement embodying the present invention.

A second embodiment of handle 100 is illustrated in FIGS. 4 and 5. In this embodiment, handle 100 includes a body 120 with freely rotating pulley 108. Pulley 108 has a band 109 freely rotating with respect to arbor 110. Band 109 may be shaped with a concave loop-receiving portion for better holding loop 54 of liftcords 28. Body 120 is generally elongated and rectangular in shape and includes a through hole 122 between pulley 108 and a surface 130. Through hole 122 allows free region 36 of liftcords 28 to be threaded through and engage pulley 108. An end portion 124 of body 120 has an I-shaped cross-section and includes first and second channels 126, 128 ending at surface 130. First and second channels function to guide liftcords 28 around pulley 108 and through the through hole 122.

A third embodiment of handle 100 is illustrated in FIGS. 6 and 7. Handle 100 is an elongated tube 132 having a longitudinal axis and first and second ends 134, 136. Tube 132 defines an elongated slot 138 parallel to the longitudinal axis and extending substantially from first end 134 of tube 132 to second end 136 of tube 132. At each end of slot 138 is a generally circular enlarged slot region 140. Enlarged slot region 140 has a diameter which is larger than the width across slot 138. A first aperture 144 is defined in tube 132 at first end 134 opposing enlarged slot region 140. A second aperture 146 (shown in phantom in FIG. 6), is defined in tube 132 at second end 136 opposing enlarged slot region 140. The purposes of the slot, slot regions, and apertures will be explained below in conjunction with a slidable shuttle. Tube 132 defines a pair of opposed channels 142 at first end 134. These channels cooperate with similar channels on a slidable shuttle, as will be explained below.

A shuttle 150, shown in phantom in FIG. 7, is slidably accommodated within tube 132. Shuttle 150 is tube shaped and is constructed and arranged for moving in tube 132 between first end 134 and second end 136. Shuttle 150 holds the pulley 108, which is for engaging the loop of liftcords 28. Shuttle 150 defines a pair of channels 152, which, when shuttle 150 is in the position near first end 134, match up with channels 142 of tube 132. Channels 142, 152 function to permit liftcords 28 to be threaded through handle 100 and engage with pulley 108. Each of channels 142, 152 end at a base surface 154. Between base surface 154 and pulley 108 is a through hole for allowing liftcords 28 to pass. Shuttle 150 includes a locking mechanism connected to the shuttle for releasably locking the shuttle near either the first end or the second end of the tube. In FIG. 7, a locking mechanism is shown generally at 156. In this particular embodiment, locking mechanism 156 includes a spring-biased locking pin 158 with a pin end 159. Pin end 159 is for engaging first and second apertures 144, 146. Locking pin 158 has a diameter which is small enough to allow locking pin 158 to slide within slot 138. Connected to locking pin 158 is a knob 160. Knob 160 has a diameter which rests within enlarged slot region 140, but which is too large to slide within slot 138.

Knob 160 is movable against the spring in the direction of arrow B (FIG. 6). In FIG. 6, when knob 160 is moved in the direction of arrow B away from tube 132, pin end 159 is moved out of engagement with first aperture 144, and knob 160 is moved out of engagement with enlarged slot region 140. Locking pin 158 slides within slot 138 in the direction of arrow C, to move shuttle 150 to second end 136 of tube 132. At second end 136, knob 160 rests within enlarged slot region 140, and pin end 159 engages second aperture 146 to lock shuttle 150 in place. With the FIGS. 6 and 7 embodiments, the inventor has discovered a way to not only change the ratio of displacement of liftcords to diplacement of the blinds, but also to completely conceal the liftcords. That is, after the liftcords are threaded through tube 132 and around the pulley, and the holder 40 is engaged to hold the free end of the liftcords, the shuttle may be slid to the second end to thereby conceal and protect the dangling liftcords within the tube. This arrangement is particularly advantageous if the blinds are used near a child's play area, and the play area includes structures which a child may climb and get near the headrail area.

The inventor contemplates that a pulley need not always be used in the handle. That is, a transverse pin fixedly mounted to the handle, but which is made of a material such that it has a low-friction engagement with the loop of the liftcords would be sufficient.

The clip 44 and handle 100 may be packaged together in a kit for retrofitting existing window blinds. The kit may also include the wall bracket 56 for mounting the clip to an adjacent wall or other structure.

In operation, the arrangement is used as follows: The free end of the liftcords are grasped by the user. If using the cylinder 102, a loop 54 of the desired length is formed first with the liftcords by attaching the free region 36 of the liftcords to either the headrail 30 or bracket 56 with clip 42. Alternatively, if modified headrail 30' is used, liftcords are pulled through opening 94 and trapped between pawl 86 and serrated wall 76. Fastener 112 is unscrewed, and arbor 110 is removed from the cylinder. Loop 54 is passed through open end 104, and arbor 110 is re-inserted into the cylinder. Fastener 112 is again connected to the arbor. The blinds may then be vertically adjusted by applying a pulling force to cylinder 102.

If handle 100 is body 120, the free end of liftcords are first threaded through the through hole 122 to engage pulley 108. The desired length of the loop is determined, and the free end of liftcords are fixed to either the headrail with clip 42 or to bracket 56 with clip 42. If modified headrail 30' is used, liftcords are pulled through opening 94 and trapped between pawl 86 and serrated wall 76. The blinds may then be vertically adjusted by applying a pulling force to body 120.

If handle 100 is tube 132, the free end of liftcords are first threaded through the channels 144, 154 to engage pulley 108. The desired length of the loop is determined, and the free end of liftcords are fixed to either the headrail with clip 42 or to bracket 56 with clip 42. If modified headrail 30' is used, liftcords are pulled through opening 94 and trapped between pawl 86 and serrated wall 76. The blinds may be vertically adjusted by applying a pulling force to tube 132. In the final step, the shuttle may be moved from the first end 134 to the second end 136 in order to conceal the liftcords.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

I claim:

1. In combination, a headrail and window blinds having liftcords with a first end attached to the blinds and a free region to vertically adjust the blinds responsive to a pulling force, the combination comprising:

(a) a locking ball having a first plurality of teeth and being moveable between first and second positions, the first position including the first teeth engaging the liftcords to lock the blinds in a desired vertical location, and the second position including the first teeth free from liftcords to allow the liftcords to move responsive to a pulling force; and (b) a pawl having a second plurality of teeth and being adjacent to the locking ball, the second teeth for releasably engaging the free region of the liftcords.

2. The combination of claim 1, further including a wall having serrations between the locking ball and the pawl, the serrations for engaging the first teeth.

3. The combination of claim 2, further including a spring engaging the pawl for biasing the pawl toward the wall, and wherein the free region of the liftcords are held between the serrations and the second teeth.

4. The combination of claim 2, wherein the wall is slanted toward the pawl to trap the free region of the liftcords between the wall and the pawl.

5. The combination of claim 1, wherein:

(a) said liftcords include a loop between said first end and said free region; said loop having a length in vertical extension from said headrail; and (b) said headrail includes a biasing arrangement; said biasing arrangement and said pawl being constructed and arranged in said headrail to permit:

(i) said length of said loop to be decreased responsive to a pulling force on said free region; and (ii) said length of said loop to be increased responsive to a pushing force on said pawl.

6. In combination, a headrail and window blinds; the window blinds having liftcords with a first end attached to the blinds and an opposite free end to vertically adjust the blinds responsive to a pulling force; the combination comprising:

(a) a first locking structure constructed and arranged to selectively and releasably engage a first section of the liftcords; and (b) a spring-biased pawl having a first plurality of teeth and being adjacent to the first locking structure; the first plurality of teeth for releasable engagement with a second section of the liftcords; said second section of the liftcords being between said first section and said free end.

7. The combination of claim 6 wherein:

(a) said first locking structure includes a locking ball having a second plurality of teeth; said locking ball being moveable between first and second positions, (i) the first position including the second teeth engaging the liftcords to lock the blinds; and (ii) the second position including the second teeth free from liftcords to allow the liftcords to move responsive to a pulling force.

8. The combination of claim 6, further including:

(a) a wall having serrations between the first locking structure and the pawl.

9. The combination of claim 8, wherein:

(a) said spring-biased pawl biases said pawl toward said wall.

10. The combination of claim 8, wherein (a) said wall is slanted toward said pawl.

11. The combination of claim 6 wherein:

(a) said liftcords include a loop between said first end and said free end; said loop having a length in vertical extension from said headrail; and (b) said spring-biased pawl is constructed and arranged in said headrail to permit:

(i) said length of said loop to be decreased responsive to a pulling force on said free end; and (ii) said length of said loop to be increased responsive to a pushing force on said pawl.

12. A headrail and liftcord arrangement comprising:

(a) a liftcord including an attachment end, an opposite free end, a looped region between said attachment end and said free end, a first section, and a second section;

(i) said attachment end for securing the liftcord to a window blind;

(ii) said looped region including a bight formed by a doubling of the liftcord between said attachment end and said free end;

(iii) said first section being between said attachment end and said bight in said looped region;

(iv) said second section being between said free end and said bight in said looped region; and (b) a headrail including:

(i) a first locking arrangement constructed and arranged to selectively and releasably secure said first section of the liftcords;

(ii) a second locking arrangement adjacent to the first locking arrangement; the second locking arrangement being constructed and arranged to releasably engage said second section of the liftcords.

13. The arrangement of claim 12, wherein:

(a) said first locking arrangement includes a locking ball moveable between locking and unlocking positions;

(i) the locking position including said ball engaging the liftcords; and (ii) the unlocking position including said ball disengaged from the liftcords.

14. The arrangement of claim 12, wherein:

(a) said second locking arrangement includes a pawl.

15. The arrangement of claim 12, wherein:

(a) said second locking arrangement includes a clip releasably attached to said headrail.

16. The combination of claim 12 wherein:

(a) said looped region includes a length in vertical extension from said headrail; and (b) said headrail includes a biasing arrangement; said biasing arrangement and said second locking arrangement being constructed and arranged in said headrail to permit:

(i) said length of said looped region to be decreased responsive to a pulling force on said free end; and (ii) said length of said loop to be increased responsive to a pushing force on said second locking arrangement.

* * * * *

UNITED STATES PATENT AND TRADEMARK OFFICE

CERTIFICATE OF CORRECTION

PATENT NO. : 5,709,258

DATED : January 20, 1998

INVENTOR(S) : Coccoluto

It is certified that error appears in the above-identified patent and that said Letters Patent is hereby corrected as shown below:

In column 3, line 57: "32°" should read —32.—.

In column 4, line 58: Insert —.— after "headrail 30′".

In column 5, line 4: "30+" should read —30′—.

In column 5, line 6: "30+" should read —30′—.

In column 7, line 9: Begin new paragraph at "With the FIGS….".

Signed and Sealed this

Twenty-second Day of September, 1998

*Attest:*

Bruce Lehman

BRUCE LEHMAN

*Attesting Officer*

*Commissioner of Patents and Trademarks*